US012075820B2

(12) United States Patent
Sakurai et al.

(10) Patent No.: US 12,075,820 B2
(45) Date of Patent: Sep. 3, 2024

(54) WRAPPING PAPER FOR NON-COMBUSTIBLE HEATED TYPE SMOKING ARTICLE, NON-COMBUSTIBLE HEATED TYPE SMOKING ARTICLE, AND ELECTRICALLY-HEATED SMOKING SYSTEM

(71) Applicant: JAPAN TOBACCO INC., Tokyo (JP)

(72) Inventors: Toru Sakurai, Tokyo (JP); Noriko Osawa, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 777 days.

(21) Appl. No.: 17/139,324

(22) Filed: Dec. 31, 2020

(65) Prior Publication Data

US 2021/0120867 A1 Apr. 29, 2021

Related U.S. Application Data

(63) Continuation of application No. PCT/JP2018/025096, filed on Jul. 2, 2018.

(51) Int. Cl.
*A24D 1/20* (2020.01)
*A24B 15/14* (2006.01)
(Continued)

(52) U.S. Cl.
CPC ..... *A24D 1/20* (2020.01); *A24B 15/14* (2013.01); *A24D 1/002* (2013.01); *A24D 1/02* (2013.01);
(Continued)

(58) Field of Classification Search
CPC . A24D 1/20; A24D 1/002; A24D 1/02; A24D 1/042; A24B 15/14; A24F 40/20;
(Continued)

(56) References Cited

U.S. PATENT DOCUMENTS 5,143,099 A 9/1992 Le Gars et al.
5,893,372 A * 4/1999 Hampl, Jr. ..... A24D 1/02 131/365
(Continued)

FOREIGN PATENT DOCUMENTS

CN 103368069 A 2/2017
CN 106368069 A * 2/2017 ..... D21D 1/02
(Continued)

OTHER PUBLICATIONS

Korean Office Action for Korean Application No. 10-2020-7037181, dated Feb. 14, 2023, with an English translation.
(Continued)

*Primary Examiner* — Justin M Kratt
(74) *Attorney, Agent, or Firm* — Birch, Stewart, Kolasch & Birch, LLP

(57) ABSTRACT

The present invention addresses the problem of providing a wrapping paper for a non-combustible heated-type smoking article with which the occurrence of staining is suppressed. The present invention resolves said problem by means of a wrapping paper for a non-combustible heated type smoking article, the wrapping paper having a basis weight of at least 35 g/m$^2$, a pulp freeness of at least 69° SR, an air permeability of no more than 20 CU, and an opacity of no more than 85%.

8 Claims, 3 Drawing Sheets

(51) Int. Cl.

| | |
|---|---|
| ***A24D 1/00*** | (2020.01) |
| ***A24D 1/02*** | (2006.01) |
| ***A24F 40/20*** | (2020.01) |
| ***A24F 40/46*** | (2020.01) |
| ***A24F 40/50*** | (2020.01) |
| ***D21H 21/16*** | (2006.01) |
| ***D21H 27/00*** | (2006.01) |
| *A24D 1/04* | (2006.01) |
| *A24F 40/57* | (2020.01) |
| *A24F 47/00* | (2020.01) |
| *D21H 27/10* | (2006.01) |

(52) U.S. Cl.
CPC ..... *A24F 40/20* (2020.01); *A24F 40/46* (2020.01); *A24F 40/50* (2020.01); *D21H 5/16* (2013.01); *D21H 21/16* (2013.01); *D21H 27/00* (2013.01); *A24D 1/042* (2013.01); *A24F 40/57* (2020.01); *A24F 47/00* (2013.01); *D21H 27/10* (2013.01)

(58) Field of Classification Search
CPC ..... A24F 40/46; A24F 40/50; A24F 40/57; A24F 47/00; D21H 5/16; D21H 21/16; D21H 27/00; D21H 27/10
See application file for complete search history.

(56) References Cited

U.S. PATENT DOCUMENTS

| | | | | |
|---|---|---|---|---|
| 2004/0074508 | A1* | 4/2004 | McAdam | A24B 15/16 131/359 |
| 2004/0159414 | A1 | 8/2004 | Durhammer | |
| 2006/0027243 | A1* | 2/2006 | Matsufuji | A24D 1/02 131/365 |
| 2015/0114414 | A1 | 4/2015 | Fritzsching et al. | |
| 2016/0157519 | A1* | 6/2016 | Guyard | A24D 1/002 131/365 |
| 2017/0215475 | A1 | 8/2017 | Besso et al. | |

FOREIGN PATENT DOCUMENTS

| | | | | |
|---|---|---|---|---|
| CN | 106480773 | A | | 3/2017 |
| EP | 0 822 760 | B1 | | 6/2003 |
| GB | 2 143 150 | A | | 2/1985 |
| JP | 3-151867 | A | | 6/1991 |
| JP | 3742793 | B2 | | 2/2006 |
| JP | 4322936 | B2 | | 9/2009 |
| JP | 2015-91232 | A | | 5/2015 |
| JP | 2017-506878 | A | | 3/2017 |
| KR | 10-2005-0121717 | A | | 12/2005 |
| KR | 10-2016-0032034 | A | | 3/2016 |
| KR | 10-2018-0070440 | A | | 6/2018 |
| KR | 20180070440 | A | * | 6/2018 |

OTHER PUBLICATIONS

Taiwanese Office Action and Search Report for Taiwanese Application No. 107123048, dated Dec. 17, 2020, with English translation.
Extended European Search Report for corresponding European Application No. 18925369.3, dated Jan. 26, 2022.
Chinese Office Action for Chinese Application No. 201880095041.X, dated Mar. 11, 2022, with English translation.
International Search Report for PCT/JP2018/025096 mailed on Sep. 4, 2018.

* cited by examiner

WRAPPING PAPER FOR NON-COMBUSTIBLE HEATED TYPE SMOKING ARTICLE, NON-COMBUSTIBLE HEATED TYPE SMOKING ARTICLE, AND ELECTRICALLY-HEATED SMOKING SYSTEM

CROSS REFERENCES TO RELATED APPLICATIONS

This application is a Continuation of PCT International Application No. PCT/JP2018/025096, filed on Jul. 2, 2018, which is hereby expressly incorporated by reference into the present application.

TECHNICAL FIELD

The present invention relates to a wrapping paper for a non-combustible heated type smoking article, a non-combustible heated type smoking article, and an electrically-heated smoking system.

BACKGROUND ART

Ordinary cigarettes are each smoked by lighting an end of a tobacco rod thereof composed of shredded tobacco, aspirating at a mouthpiece end of the cigarette, and inhaling air mainly through the ignition end. However, during smoking, cigarettes burn at a temperature above 800° C. Various problems may occur in association with burning at such a high temperature. Therefore, non-combustible heated type smoking articles that use electric heating have been developed as an alternative to ordinary cigarettes (Patent Documents 1 and 2).

Generally, the heating temperature of a non-combustible heated type smoking article is lower than a burning temperature of ordinary cigarettes. Thus, in order to impart sufficient and favorable flavor and taste, in the non-combustible heated type smoking article, it is necessary to increase an amount of shredded tobacco used in the tobacco rod thereof greater than that in ordinary cigarettes, and this bring about a tendency toward an increase in filling density. Therefore, generally, the wrapping paper for wrapping a tobacco rod in the non-combustible heated type smoking article needs to have a higher strength than that of the wrapping paper used in an ordinary cigarette.

In addition, in the non-combustible heated type smoking article, since the heating temperature is lower than a burning temperature of an ordinary cigarette, the amount of smoke generated therefrom is small, hence it is necessary to increase the amount of a fragrance material to be added to shredded tobacco greater than that to be added to an ordinary cigarette.

As described above, in the non-combustible heated type smoking article having a high filling density of shredded tobacco and a large amount of fragrance material added, a problem of a rise of a fragrance material to the surface of the wrapping paper (occurrence of stains) is more evident than in an ordinary cigarette.

Generally, the reason for the occurrence of stains on the wrapping paper is considered that, during storage of a smoking article, substances contained in the smoking article exude into the wrapping paper at a part at which the wrapping paper for the smoking article is in contact with shredded tobacco.

In Patent Document 3, an inner wrapping paper having a specific air permeability is disposed between a filler and the outer wrapping paper, which constitute a cigarette, whereby the occurrence of stains on the wrapping paper is suppressed. It is described that the basis weight of the inner wrapping paper is a maximum of 30 g/m$^2$.

In addition, Patent Document 4 discloses a method of suppressing the occurrence of stains on a wrapping paper, the method including applying a water repellent agent composed of cellulose derivatives to a wrapping paper and drying the same to form a first layer, and applying thereto cellulose derivatives to form a second layer, thereby forming a wrapping paper impregnated with the water repellent agent.

CITATION LIST

Patent Documents

Patent Document 1: Japanese Translation of PCT Application No. 2017-506878

Patent Document 2: Japanese Patent No. 4322936

Patent Document 3: Japanese Patent Application Publication No. H 03-151867

Patent Document 4: U.S. Patent Application Publication No. 2004/0159414

SUMMARY OF INVENTION

Technical Problem

In the invention described in Patent Document 3, it is mandatory to use two types of wrapping papers, i.e., an outer wrapping paper and an inner wrapping paper, as wrapping paper which causes a problem in productivity, costs, and maintaining the flavor and taste.

In the invention described in Patent Document 4, a water repellent agent such as cellulose derivatives is double-coated on a wrapping paper. Such a substance coating is effective in suppressing the occurrence of stains, but it is necessary to apply a relatively large amount thereof in order to obtain a sufficient effect, which has a great influence on the flavor and taste quality, burning ability, and air permeability, and thus a degree of freedom in design may be impaired.

Thus, it can be said that there is room for improvement in the related art that has been used in order to suppress the occurrence of stains on a wrapping paper, and in a non-combustible heated type smoking article having a high filling density of shredded tobacco and containing a large amount of an aerosol generating base material and a fragrance material added, there is a demand for a wrapping paper in which the occurrence of stains is suppressed more than in the related art, and particularly, a wrapping paper in which the occurrence of relatively large size stains is suppressed.

Thus, an object of the present invention is to provide a wrapping paper for a non-combustible heated type smoking article in which the occurrence of stains is suppressed and particularly, the occurrence of relatively large size stains is suppressed.

Solution to Problem

The inventors conducted extensive studies in order to solve the above problems and as result, found that, when a basis weight, a pulp freeness, an air permeability, and an opacity of a wrapping paper are controlled to be within a specific range, the occurrence of stains is suppressed, and completed the present invention. Specifically, the scope of the present invention is as follows.

[1] A wrapping paper for a non-combustible heated type smoking article, having a basis weight of 35 g/m$^2$ or more, a pulp freeness of 69° Schopper-Riegler (SR) or more, an air permeability of 20 Coresta Units (CU) or less, and an opacity of 85% or less.

[2] The wrapping paper for a non-combustible heated type smoking article according to [1], wherein a water contact angle is less than 90°.

[3] The wrapping paper for a non-combustible heated type smoking article according to [1] or [2], having 35 weight % or more of a filler.

[4] A non-combustible heated type smoking article comprising a filler containing shredded tobacco and an aerosol generating base material, a tobacco rod part wrapped with a first wrapping paper that wraps the filler, and a mouthpiece part constituting an end on an opposite side to the tobacco rod part, the tobacco rod part and the mouthpiece part being connected using a second wrapping paper which is the same as or different from the wrapping paper that wraps the filler, wherein at least one of the first wrapping paper and the second wrapping paper is the wrapping paper according to any of [1] to [3].

[5] The non-combustible heated type smoking article according to [4], wherein the tobacco rod part includes a filler containing shredded tobacco and an aerosol generating base material, and a density of the filler is 250 mg/cm$^3$ or more, and a content of the aerosol generating base material in the filler is 5 weight % or more.

[6] The non-combustible heated type smoking article according to [4] or [5], wherein the tobacco rod part includes a filler containing a fragrance material and a content of the fragrance material is 10,000 ppm or more.

[7] An electrically-heated smoking system, including: an electric heating device including a heater member, a heat transfer member that transfers heat from the heater member, a battery unit serving as a power source of the heater member, and a control unit for controlling the heater member; and the non-combustible heated type smoking article according to any one of [4] to [6], which is fitted so as to come in contact with the heat transfer member.

Advantageous Effects of Invention

According to the present invention, it is possible to provide a wrapping paper for a non-combustible heated type smoking article in which the occurrence of stains is suppressed and particularly, the occurrence of relatively large size stains is suppressed.

DESCRIPTION OF EMBODIMENTS

Figure 1:
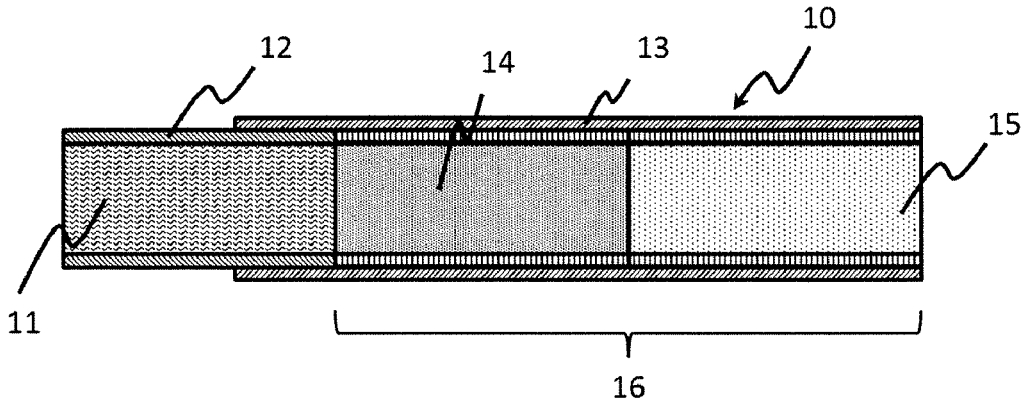
FIG. 1 is a schematic view showing one mode of a non-combustible heated type smoking article.

Embodiments of the present invention will be described below in detail. The following embodiment is an example (representative example) of the embodiment of the present invention, and the present invention is not limited thereto. In addition, the present invention can be arbitrarily modified and implemented without departing from the scope and spirit of the invention.

Here, in this specification, when a numerical value or a physical property value is expressed using "to," values stated before and after "to" are included.

In addition, in this specification, the expression "smoking temperature" may be used as a general term for a "heating temperature" in a non-combustible heated type smoking article and a "burning temperature" in ordinary cigarettes.

In addition, in this specification, the expression "smoke" may be used as a general term for vaporized substances and aerosolized substances.

In addition, in this specification, "the occurrence of stains" means a phenomenon in which a component derived from shredded tobacco, a fragrance material, or the like rises to the surface of the wrapping paper in a visually recognizable manner.

<Wrapping Paper for a Non-Combustible Heated Type Smoking Article>

A wrapping paper for a non-combustible heated type smoking article according to one embodiment of the present invention (hereinafter referred to as "wrapping paper according to one embodiment of the present invention" in some cases) has a basis weight of 35 g/m$^2$ or more, a pulp freeness of 69° SR or more, an air permeability of 20 CU or less, and an opacity of 85% or less.

The base paper which is a base material used for the wrapping paper according to one embodiment of the present invention is not particularly limited, and examples thereof include those using a cellulose fiber as a material. Regarding such a cellulose fiber, more specifically, either a plant-derived fiber or a chemically synthesized fiber may be used, or a mixture thereof may be used. Examples of plant-derived fibers include pulp such as a flax fiber, a wood fiber, and a seed fiber, and unbleached colored pulp that is not bleached may be used, and in consideration of a white and clean paper appearance, bleached pulp bleached with a bleaching agent such as an oxidant or a reducing agent is preferably used.

The length and thickness of the fiber of the base paper which is a base material used for the wrapping paper according to one embodiment of the present invention are not particularly limited, and generally a length of 0.1 mm to 5 mm and a thickness of 10 μm to 60 μm.

The wrapping paper according to one embodiment of the present invention may contain a filler, and the type of the filler is not particularly limited, and examples thereof include metal carbonates such as calcium carbonate and magnesium carbonate, metal oxides such as titanium oxide and aluminum oxide, metal sulfates such as barium sulfate and calcium sulfate, metal sulfides such as zinc sulfide, quartz, kaolin, talc, diatomaceous earth, and gypsum, and particularly, it is preferable to include calcium carbonate in order to improve the whiteness and opacity and prevent an influence on flavor and taste. In addition, these fillers may be used alone or two or more thereof may be used in combination.

In order to secure the opacity, the content of the filler in the wrapping paper according to one embodiment of the present invention is generally 5 weight % or more, preferably 10 weight % or more, more preferably 30 weight % or more, and still more preferably 35 weight % or more, and generally 60 weight % or less, and preferably 50 weight % or less. Here, for example, in order to determine the content of calcium carbonate, it can be determined by measuring an ash content or quantify calcium ions after extracting.

In addition, the average particle size of the filler is not particularly limited, and generally 3.0 μm to 3.5 μm.

The wrapping paper easily burns below the lower limit of the above range and the strength of the wrapping paper is significantly reduced above the upper limit, and during high-speed manufacture of tobacco operated at several thousand cigarettes/minute, paper breaking frequently occurs, and so-called winding suitability may deteriorate.

In the wrapping paper according to one embodiment of the present invention, various auxiliary agents other than a base paper and a filler may be added as long as the effects of the present invention are not impaired. Regarding an auxiliary agent, a paper strength enhancing agent may be added, and examples thereof include polyacrylamide, cationic starch, oxidized starch, CMC, and polyvinyl alcohol, and when used, generally 0.1 weight % to 2.0 weight %, or preferably 0.2 weight % to 1.0 weight % is added. In particular, it is known that, when a very small amount of oxidized starch is used, the air permeability is improved (Japanese Patent Application Publication No. 2017-218699).

In addition, for example, in order to improve the water resistance, a water resistance improving agent can be included. The water resistance improving agent includes a wet paper strength enhancing agent (WS agent) and a size agent. Examples of wet paper strength enhancing agents include a urea formaldehyde resin, a melamine formaldehyde resin, and polyamide epichlorohydrin (PAE), and when used, generally 0.1 weight % to 2 weight % is added. In addition, examples of size agents include rosin soap, an alkyl ketene dimer (AKD), alkenyl succinic anhydride (ASA), and highly saponified polyvinyl alcohols having a degree of saponification of 90% or more, and when used, generally 0.1 weight % to 2 weight % is added.

In the case of an ordinary cigarette wrapping paper, an alkali metal citrate or the like is used as a general burning regulating agent (a burn improver, etc.) that may influence a natural burning rate of the wrapping paper, and in the case of the wrapping paper according to one embodiment of the present invention, the burning regulating agent may not be included because there is no need to burn the wrapping paper.

The basis weight of the wrapping paper according to one embodiment of the present invention is 35 $g/m^2$ or more, and preferably 40 $g/m^2$ or more and generally 65 $g/m^2$ or less, and preferably 50 $g/m^2$ or less. The basis weight can be measured by the method defined in JIS P 8124.

Within the above range, it is possible to suppress the occurrence of stains and maintain appropriate winding suitability.

In addition, the basis weight of the wrapping paper can be adjusted by adjusting the type and content of the filler. For example, the basis weight can be increased by adding a filler having a high density or the basis weight can be decreased by adding a filler having a low density, and even if fillers have the same density, the basis weight can be increased or decreased by increasing or decreasing the content.

In the wrapping paper according to one embodiment of the present invention, the pulp freeness of the wrapping paper is 69° SR or more, preferably 72° SR or more, more preferably 75° SR or more, and still more preferably 78° SR or more, and the pulp freeness is 100° SR or less in terms of the measurement principle, preferably 95° SR or less, more preferably 90° SR or less, and still more preferably 85° SR or less. Here, the pulp freeness can be measured by the Schopper-Riegler method defined in JIS P 8121-1:2012. Here, the pulp freeness in the present invention means the freeness of pulp used as a raw material for the wrapping paper.

Within the above range, it is possible to suppress the occurrence of stains and maintain appropriate strength.

In addition, the pulp freeness of the wrapping paper can be controlled by adjusting the freeness of pulp used, and examples of an adjustment method include changing conditions for pulp pulping and beating.

The air permeability of the wrapping paper according to one embodiment of the present invention is 20 Coresta units (CU) or less and preferably 15 CU or less, and generally 0 CU or more and preferably 1 CU or more. Here, the air permeability is a value measured according to ISO 2965: 2009, and represents a flow rate ($cm^3$) of a gas that passes through an area of 1 $cm^2$ per minute when a pressure difference between both surfaces of paper is 1 kPa. One Coresta unit (1 CU) is a unit represented by $cm^3/(min \cdot cm^2)$ under 1 kPa.

Within the above range, it is possible to suppress the occurrence of stains and maintain appropriate rigidity and air permeability.

In addition, the air permeability of the wrapping paper can be adjusted by controlling conditions for a pulp beating process and the content of pulp, controlling the type and content of the filler, and according to operation conditions such as a dehydration rate, a drying rate, and a calendar treatment in the papermaking process.

The opacity of the wrapping paper according to one embodiment of the present invention is 85% or less and preferably 83% or less and generally 65% or more, preferably 70% or more, more preferably 75% or more, and still more preferably 80% or more. Here, the opacity is a value measured according to ISO 2471.

Within the above range, it is possible to reduce the number of stains, and particularly, the number of stains having a relatively large size. In addition, if the opacity exceeds the upper limit of the above range, deterioration in the appearance due to the contrast between the white color of the wrapping paper and the yellowish brown color of stains becomes noticeable, and if the opacity is below the lower limit of the above range, the filler in the tobacco rod is transparent and thus deterioration in the appearance of the entire wrapping paper occurs.

In addition, the opacity of the wrapping paper can be adjusted by adjusting the content of the filler or the like, and generally, the opacity can be increased by increasing the content of the filler.

The thickness of the wrapping paper according to one embodiment of the present invention is not particularly limited, and in consideration of rigidity, air permeability, and ease of preparation during papermaking, it is generally 10 μm or more, preferably 20 μm or more, and more preferably 30 μm or more, and generally 200 μm or less, preferably 150 μm or less, and more preferably 100 μm or less.

The water contact angle of the surface of the wrapping paper according to one embodiment of the present invention is not particularly limited and is generally less than 90°, preferably less than 70°, more preferably less than 50°, still more preferably less than 40°, particularly preferably less than 30°, and most preferably less than 20°. A small water contact angle means that a surface treatment for increasing a water contact angle, for example, application of a coating agent, may not be performed. When such a surface treatment is not performed, it is possible to manufacture a wrapping paper having favorable winding suitability with a small number of processes without influencing flavor and taste.

In order to keep the water contact angle on the surface of the wrapping paper within the above range, it is preferable that the surface of the wrapping paper be not hydrophobic. Specifically, it is preferable not to perform a treatment such as laminating a hydrophobic film on the surface of the wrapping paper or applying a hydrophobic solution, and more specifically, for example, in order to prevent an influence on the flavor and taste, it is preferable not to include a fatty acid and/or fatty acid ester covalently bonded to the surface of the wrapping paper. Here, the presence of a fatty acid and/or fatty acid ester covalently bonded to the surface of the wrapping paper can be verified by measuring an infrared spectrum, measuring a Raman spectrum, or the like.

In order to reduce the number of stains, increasing the water contact angle (water contact angle: 90° or more) is also effective, and in order to increase the water contact angle, a specific surface treatment, for example, applying a lipophilic coating agent, is necessary. Although the water contact angle of the wrapping paper according to one embodiment of the present invention is not specified, a stain reduction effect is exhibited even at a low contact angle (less than 90°) without performing a specific surface treatment.

The surface of the wrapping paper according to one embodiment of the present invention may be coated as long as the effects of the present invention are not impaired, but it is preferable that the surface be not coated in consideration of productivity deterioration and cost increase due to addition of the coating process.

The wrapping paper according to one embodiment of the present invention can be manufactured by any known method: for example, it can be manufactured by the following method.

First, pulp is put into a pulper, and the pulp is disaggregated. Next, the disaggregated pulp is transferred to a refiner, and beaten in the refiner. When beating conditions are appropriately changed, it is possible to adjust the pulp freeness of the wrapping paper of the present invention. Separately, for example, calcium carbonate as a filler, and as necessary, a flocculation agent as a manufacturing agent, are prepared, and these are mixed with beaten pulp.

Next, in the papermaking process using the mixed pulp performed by a Fourdrinier papermaking machine, a cylinder papermaking machine, a short circular composite papermaking machine, or the like, wrapping paper with an adjusted and uniform texture is manufactured. Here, as necessary, the above wet paper strength enhancing agent is added to impart water resistance to the wrapping paper, and for use in a tipping paper part, a size agent can be added to adjust wrapping paper printing conditions. In addition, papermaking internal additives such as a sulfate band, various anionic, cationic, nonionic or amphoteric yield improving agents, a freeness improving agent, and a paper strength enhancing agent, and also papermaking additives such as a pigment, a pH adjusting agent, an anti-foaming agent, a pitch control agent, and a slime control agent can be added.

In addition, the wrapping paper manufactured above may be subjected to calendar processing in which a pressing pressure is applied using a calendar roller. The calendar processing method and conditions are not particularly limited: for example, the method and conditions described in WO 2008/072523 can be used. According to calendar processing, the density of the wrapping paper can be increased and the air permeability can be reduced.

<Non-Combustible Heated Type Smoking Article>

Regarding the non-combustible heated type smoking article according to the embodiment of the present invention, for example, an article having the configuration in FIG. 1 may be exemplified.

A non-combustible heated type smoking article 10 in FIG. 1 includes a filler 11, a tobacco rod part (referred to as a "tobacco rod") composed of a first wrapping paper 12 that wraps the filler 11, and a mouthpiece part 16 constituting an end opposite to the tobacco rod part, and the tobacco rod part and the mouthpiece part are connected using a second wrapping paper 13 (tipping paper in FIG. 1) which is the same as or different from the wrapping paper that wraps the filler.

At least one of the first wrapping paper and the second wrapping paper is the wrapping paper according to the embodiment of the present invention described above. At least the first wrapping paper is preferably the wrapping paper according to the embodiment of the present invention. In addition, both the first wrapping paper 12 and the second wrapping paper are preferably the wrapping paper according to the embodiment of the present invention described above.

In the mode shown in FIG. 1, the mouthpiece part 16 includes a paper tube part 14 and a filter part 15. In addition, a tipping paper 13 is provided as a second wrapping paper for connecting the parts. Here, in FIG. 1, the mouthpiece part 16 is composed of two segments, but the mouthpiece part 16 may be composed of a single segment or three or more segments. In addition, the segment constituting the mouthpiece part may include both the paper tube part and the filter part or may include only one of them.

When water vapor containing an aerosol generating base material and a tobacco flavor component generated when the tobacco rod is heated passes through the paper tube part 14, it comes in contact with air in the paper tube and is cooled and liquefied to generate an aerosol.

In addition, the non-combustible heated type smoking article 10 may include the paper tube part 14 and micropores for receiving air from the outside in a part of the second wrapping paper 13 (tipping paper) that covers the periphery of the paper tube part 14 (not shown). When such micropores are provided, air flows into the paper tube part 14 from the outside during use, water vapor containing an aerosol generating base material and a tobacco flavor component generated when the tobacco rod is heated comes in contact with air from the outside and is liquefied when the temperature decreases, and an aerosol is more reliably generated.

The paper tube part 14 may be, for example, a part obtained by processing a cardboard into a cylindrical shape.

The material and configuration of the filter part 15 are not particularly limited as long as it is possible to reduce an amount of vaporized or aerosolized substances by filtration or adsorption thereby, and known materials and configurations can be used. For example, regarding the material of the filter part 15, first, a material filled with a fiber bundle containing acetate tow, cellulose, cellulose ester, or a polyolefin may be used. In addition, an adsorbent may be contained, and examples of materials of the adsorbent include activated carbon; metal oxides such as silica, alumina, titania, aluminosilicates, and zeolites; mesoporous silica and silica gel; clay minerals such as hydrotalcite and sepiolite; deionized resins; and their surface modified products and gelled products.

In addition, in the configuration of the filter part 15, the material may be dense as a whole, may be divided into a plurality of segments, or may have a tubular configuration having a cavity in a part in the axial direction, or a part thereof may constitute a paper tube having a cooling function. When the configuration includes a plurality of segments, for example, a mode in which a hollow segment is disposed on the upstream side and a mouthpiece cross section is filled with acetate tow as a downstream side (user's mouthpiece end side) segment may be exemplified. In such a mode, it is possible to prevent unnecessary loss of a generated aerosol and improve the appearance of the non-combustible heated type smoking article.

In addition, in manufacture of a filter, adjustment of the air flow-resistance and addition of additives (a known adsorbent, a fragrance material, a fragrance material holding material, and the like) can be appropriately designed.

The material of the second wrapping paper 13 (tipping paper) is not particularly limited, and the wrapping paper according to the embodiment of the present invention may be partially or entirely used. For example, the second wrapping paper 13 may have a mode in which a vinyl acetate paste is used to wrap the periphery of the tobacco rod, the paper tube part 14, and the filter part 15 and fixing is then performed.

The tobacco rod includes a tobacco plant (in this specification, also referred to as "shredded tobacco") as the filler 11, and any part of the tobacco plant may be used, and examples thereof include lamina, internodes, stems, flowers, and roots. In particular, in order to deliver a large amount of taste and flavor by heating, lamina is preferably used. In addition, in order to adjust the taste and flavor, various components such as tobacco varieties and tobacco parts can be blended in and filled.

In addition, there are various processing methods before filling the previous filler 11, and pieces obtained by dried shredded tobacco into a width of 0.8 to 1.2 mm may be used for filling, pieces obtained by crushing tobacco so that they have an average particle size of about 20 to 200 μm, performing homogenizing, then performing sheet processing and performing shredding into a width of 0.8 to 1.2 mm may be used for filling, or the sheet-processed pieces may be gathered and processed without shredding and filled into the rod.

In order to impart favorable flavor and taste, the content of shredded tobacco in the filler is generally 20 weight % or more, preferably 30 weight % or more, and more preferably 40 weight % or more and generally 80 weight % or less, preferably 70 weight % or less, and more preferably 60 weight % or less.

The above range is a range specific to the non-combustible heated type smoking article for which it is necessary to transfer heat efficiently because the smoking temperature is lower than that of ordinary cigarettes, and the content of ordinary cigarettes is generally below the lower limit of the above range.

The filler 11 may include an aerosol generating base material that generates aerosol smoke. The type of the aerosol generating base material is not particularly limited, and specific examples thereof include polyhydric alcohols such as propylene glycol (PG), triethylene glycol, 1,3-butylene glycol and glycerin; esters of polyhydric alcohols such as glycerol mono-, di- or triacetates; and aliphatic esters of mono-, di- or polycarboxylic acids such as dimethyl dodecanedioate and dimethyl tetradecanedioate, and in consideration of the relationship between the heating temperature of the smoking article and the melting point/boiling point, and ease of obtaining a desired aerosol, propylene glycol (PG) and glycerin are particularly preferable.

In order to impart favorable flavor and taste, the content of the aerosol generating base material in the filler is generally 5 weight % or more and preferably 10 weight % or more and generally 60 weight % or less and preferably 40 weight % or less.

The filler 11 may contain a fragrance material. The type of the fragrance material is not particularly limited, and in order to impart favorable flavor and taste, acetoanisole, acetophenone, acetylpyrazine, 2-acetylthiazole, alfalfa extract, amyl alcohol, amyl butyrate, trans-anethole, star anise oil, apple juice, Peruvian balsam oil, beeswax absolute, benzaldehyde, benzoin resinoid, benzyl alcohol, benzyl benzoate, benzyl phenylacetate, benzyl propionate, 2,3-butanedione, 2-butanol, butyl butyrate, butyric acid, caramel, cardamom oil, carob absolute, β-carotene, carrot juice, L-carvone, β-caryophyllene, cassia bark oil, cedarwood oil, celery seed oil, chamomile oil, cinnamaldehyde, cinnamic acid, cinnamyl alcohol, cinnamyl cinnamate, citronella oil, DL-citronellol, clary sage extract, cocoa, coffee, cognac oil, coriander oil, cumin aldehyde, davana oil, 5-decalactone, γ-decalactone, decanoic acid, dill herb oil, 3,4-dimethyl-1,2-cyclopentanedione, 4,5-dimethyl-3-hydroxy-2,5-dihydrofuran-2-one, 3,7-dimethyl-6-octenoic acid, 2,3-dimethylpyrazine, 2,5-dimethylpyrazine, 2,6-dimethylpyrazine, ethyl 2-methylbutyrate, ethyl acetate, ethyl butyrate, ethyl hexanoate, ethyl isovalerate, ethyl lactate, ethyl laurate, ethyl levulinate, ethyl maltol, ethyl octoate, ethyl oleate, ethyl palmitate, ethyl phenylacetate, ethyl propionate, ethyl stearate, ethyl valerate, ethyl vanillin, ethyl vanillin glucoside, 2-ethyl-3,(5 or 6)-dimethylpyrazine, 5-ethyl-3-hydroxy-4-methyl-2(5H)-furanone, 2-ethyl-3-methylpyrazine, eucalyptus, fenugreek absolute, genet absolute, gentian root infusion, geraniol, geranyl acetate, grape juice, guaiacol, guava extract, γ-heptalactone, γ-hexalactone, hexanoic acid, cis-3-hexene-1-ol, hexyl acetate, hexyl alcohol, hexyl phenylacetate, honey, 4-hydroxy-3-pentenoic acid lactone, 4-hydroxy-4-(3-hydroxy-1-butenyl)-3,5,5-trimethyl-2-cyclohexen-1-one, 4-(para-hydroxyphenyl)-2-butanone, sodium 4-hydroxyundecanoate, immortelle absolute, β-ionone, isoamyl acetate, isoamyl butyrate, isoamyl phenylacetate, isobutyl acetate, isobutyl phenylacetate, jasmine absolute, cola nut tincture, labdanum oil, lemon terpeneless oil, licorice extract, linalool, linalyl acetate, lovage root oil, maltol, maple syrup, menthol, menthone, L-menthyl acetate, paramethoxybenzaldehyde, methyl-2-pyrrolyl ketone, methyl anthranilate, methyl phenylacetate, methyl salicylate, 4'-methylacetophenone, methylcyclopentenolone, 3-methylvaleric acid, mimosa absolute, molasses, myristic acid, nerol, nerolidol, γ-nonalactone, nutmeg oil, δ-octalactone, octanal, octanoic acid, orange flower oil, orange oil, orris root oil, palmitic acid, ω-pentadecalactone, peppermint oil, petitgrain paraguay oil, phenethyl alcohol, phenethyl acetate, phenylacetic acid, piperonal, plum extract, propenyl guaetol, propyl acetate, 3-propylidenephthalide, prune juice, pyruvic acid, raisin extract, rose oil, rum, sage oil, sandalwood oil, spearmint oil, styrax absolute, marigold oil, tea distillate, α-terpineol, terpinyl acetate, 5,6,7,8-tetrahydroquinoxaline, 1,5,5,9-tetramethyl-13-oxacyclo(8.3.0.0 (4.9)) tridecane, 2,3,5,6-tetramethylpyrazine, thyme oil, tomato extract, 2-tridecanone, triethyl citrate, 4-(2,6,6-trimethyl-1-cyclohexenyl)2-buten-4-one, 2,6,6-trimethyl-2-cyclohexene-1,4-dione, 4-(2,6,6-trimethyl-1,3-cyclohexadienyl)2-buten-4-one, 2,3,5-trimethylpyrazine, γ-undecalactone, γ-valerolactone, vanilla extract, vanillin, veratraldehyde, or violet leaf absolute may be exemplified, and menthol is particularly preferable. In addition, these fillers may be used alone or two or more thereof may be used in combination.

In order to impart favorable flavor and taste, the content of the fragrance material in the filler is generally 10,000 ppm or more, preferably 20,000 ppm or more, and more preferably 25,000 ppm or more and generally 50,000 ppm or less, preferably 40,000 ppm or less, and more preferably 33,000 ppm or less.

The above range is a range specific to a non-combustible heated type smoking article in which the amount of smoke generated is small because the smoking temperature is lower than that of ordinary cigarettes, and the content in ordinary cigarettes is generally below the lower limit of the above range.

The filling density of the filler 11 is not particularly limited, and in order to impart favorable flavor and taste, it is generally 250 mg/cm$^3$ or more and preferably 290 mg/cm$^3$ or more, and generally 520 mg/cm$^3$ or less and preferably 420 mg/cm$^3$ or less.

The above range is a range specific to a non-combustible heated type smoking article for which it is necessary to increase the amount of the filler 11 because the smoking temperature is lower than that of ordinary cigarettes, and the filling density of ordinary cigarettes is generally below the lower limit of the above range.

In the case of a tobacco rod having a circumference of 22 mm and a length of 20 mm, the range of the content of the filler 11 in the tobacco rod may be 200 to 400 mg/rod and is preferably 250 to 320 mg/rod. The water content of the filler 11 may be 10 to 15 weight % and is preferably 11 to 13 weight %. With such a water content, the winding suitability when the tobacco rod is manufactured is improved.

<Electrically-Heated Smoking System>

Figure 2:
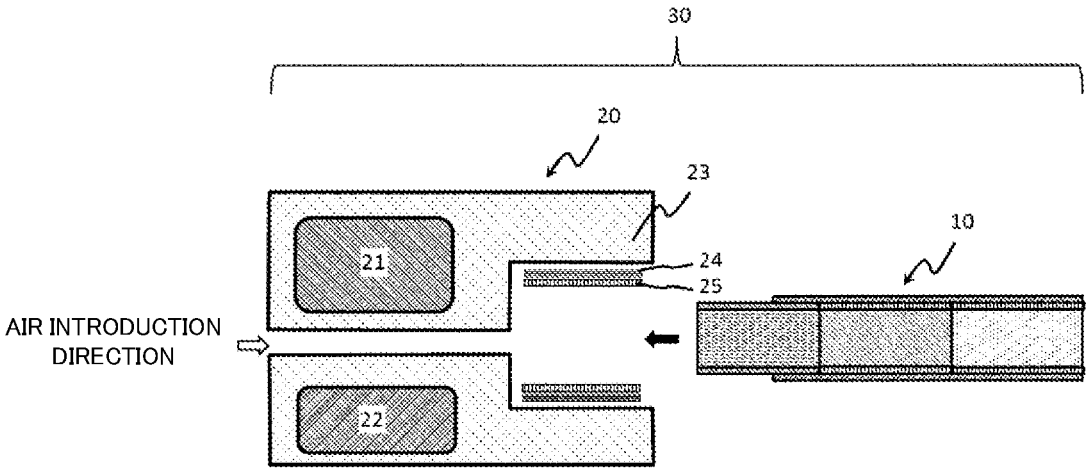
FIG. 2 is a schematic view showing one mode of an electrically-heated smoking system.

FIG. 2 shows one mode of an electrically-heated smoking system. An electrically-heated smoking system 30 is used by being fitted so that the non-combustible heated type smoking article 10 described above comes in contact with a heat transfer member 25 in contact with a heater 24 disposed in an electric heating device 20.

For example, the electric heating device 20 includes a battery unit 21 and a control unit 22 inside a resinous body 23.

As described above, the non-combustible heated type smoking article 10 includes the filler 11, a tobacco rod part composed of the first wrapping paper 12 that wraps the filler 11, and the mouthpiece part 16 constituting an end opposite to the tobacco rod part, and the tobacco rod part and the mouthpiece part are connected using a second wrapping paper which is the same as or different from the wrapping paper that wraps the filler 11. When the non-combustible heated type smoking article 10 is fitted to an electric heating device, a part of the outer circumferential surface composed of the outer circumferential surface of the tobacco rod and the second wrapping paper (the tipping paper 13) that connects the tobacco rod to the paper tube part 14 comes in contact with the heat transfer member 25 inside the electric heating device 20.

The heater 24 inside the electric heating device 20 generates heat under control of the control unit 22. The heat is transferred to the tobacco rod of the non-combustible heated type smoking article 10 through the heat transfer member 25, and both the aerosol generating base material and the flavor component contained in the filler 11 of the tobacco rod are volatilized.

The tobacco rod is heated to about 150° C. to 250° C. by heating using the heater 24.

Water vapor containing the aerosol generating base material and the flavor component generated by heating is aerosolized inside the paper tube part 14 according to the mechanism described above, passes through the filter part 15 of the non-combustible heated type smoking article 10, and reaches the user's oral cavity.

EXAMPLES

While the present invention will be described in more detail with reference to examples, the present invention is not limited to the description of the following examples without departing from the scope and spirit of the invention.

Production of Wrapping Paper

Example 1

Pulp (wood) was beaten to 69° SR by the Schopper-Riegler method, and calcium carbonate (carbonic acid Ca) was added to the beaten pulp so that the content shown in Table 1 Was obtained. A wrapping paper was prepared using the obtained paper material in a Fourdrinier tubular type papermaking machine. The wrapping paper was used as a 3,000 m wrapping product having a width of 26.5 mm, and a wrapping paper of Example 1 having physical properties shown in Table 1 was obtained. In Example 2, before shredding into a width of 26.5 mm, a high-pressure treatment (a treatment temperature of 40° C., a linear pressure of 50 kg, a rate of 200 m/min, and 9-step nip in which metal cotton was trapped) was performed in a calendar processing machine. In Comparative Examples 1 to 5, settings of the voltage of the beating machine, the header height of the papermaking machine, and the filler proportional content were changed for production so that the beating degree, the basis weight, and the filler shown in Table 1 were obtained, and wrapping products having a width of 26.5 mm were obtained in the same manner as in Examples 1 and 2.

<Evaluation of Wrapping Paper>

Physical properties of the wrapping paper shown in Table 1 were evaluated as follows.

(Basis Weight)

The basis weight of the wrapping paper was evaluated by the method defined in JIS P 8124.

(Pulp Freeness)

The pulp freeness of the raw material of the wrapping paper was evaluated by the Schopper-Riegler method defined in JIS P 8121-1:2012.

(Air Permeability)

The air permeability of the wrapping paper was measured by the method defined in ISO 2965:2009 using PPM1000 (commercially available from CERULEANA).

(Carbonic Acid Ca)

The content of calcium carbonate of the wrapping paper was evaluated by a product of the basis weight and the ash content. The ash content was evaluated by the method defined in JIS P 8003.

(Opacity)

The opacity was a value measured according to ISO 2471 using a whiteness/opacity measuring machine (manufacturer: Murakami Color Research Laboratory, model number: WMS-1). The opacity was a value calculated by a calculation formula: single-sheet luminous reflectance factor (R0)/intrinsic luminous reflectance factor ($R^{\infty}$)×100(%). The intrinsic luminous reflectance factor ($R^{\infty}$) of this calculation formula was an intrinsic reflectance factor of whiteness when measured under spectral conditions of an effective wavelength of 457 nm and a half width of 44 nm using a specific reflectometer and light source.

<Production of Rod>

The wrapping papers of Examples 1 and 2 and Comparative Examples 1 to 5 were rolled up by a high-speed winding machine. The shredded tobacco used were prepared by mixing shredded tobacco with 2 g/100 g of a fragrance material and 40/100 g of an aerosol generating base material (glycerin) in advance. The weight of shredded tobacco per rod was 0.8 g, the winding circumference was 24.5 mm, and the winding length was 68 mm. 200 rolled-up tobacco rods were put into and stored in plastic sealed containers at each level. Here, it was confirmed that there were no stains on the surface of the tobacco rod immediately after rolling up.

<Evaluation of Stains>

Figure 3:
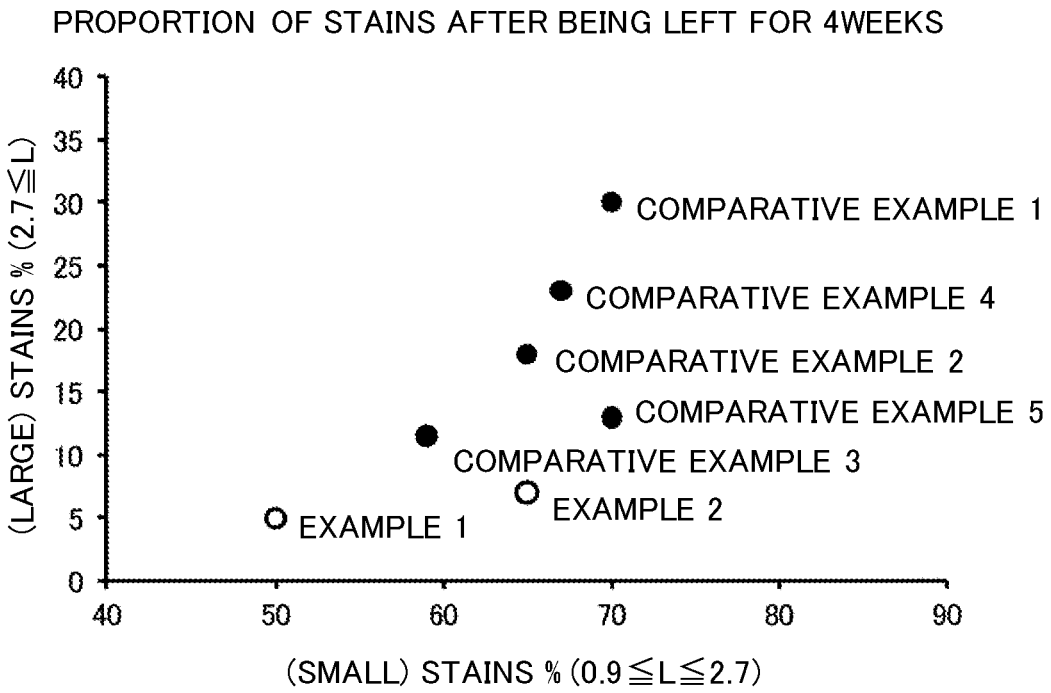
FIG. 3 is a diagram showing proportions of stains on rods for non-combustible heated type smoking articles of Examples 1 and 2 and Comparative Examples 1 to 5 after being left for 4 weeks.

The sealed containers containing the rods produced using Examples 1 and 2 and Comparative Examples 1 to 5 were left under an environment of a temperature of 22° C. and a relative humidity of 60% for 4 weeks, and the tobacco rods were then removed from the container, and the number of stains occurring on the surface of the wrapping paper was visually evaluated. In the evaluation, those having a maximum stain diameter (L) of 0.9 mm L<2.7 mm (small stains), and those having a maximum stain diameter (L) of 2.7 mm L (large stains) were measured separately. The evaluation results are shown in Table 1 and FIG. 3. Here, the wrapping papers containing both large and small stains were counted as large stains.

In this evaluation, the unit of stain is each stain that can be approximated to an ellipse (including a circle) regardless of whether it was independent of other stains. In addition, the degree of stain occurrence was indicated by the number of stains occurred in 200 inspections, and the proportion % of occurrence at each level of large, small, or none.

<Evaluation of Water Contact Angle>

Measurement was performed on the wrapping papers of Examples 1 and 2, and Comparative Examples 1 to 5 under the following conditions using a commercially available contact angle measurement device, according to JIS R 3257:1999. In the measurement results, the water contact angle was less than 35° in all of the examples and comparative examples.

[Water contact angle measurement conditions]

Measurement device: fully automatic contact angle meter DMC-MC3 (commercially available from Kyowa Interface Science Co., Ltd.)

Measurement atmosphere: 22° C., 60% RH

Measurement liquid: distilled water

Measurement time: 100 ms after drop adhesion

Liquid volume: 2.5 μl

Analysis method: angle measurement by θ/2 method

Based on Table 1, it was found that, in Examples 1 and 2 using the wrapping paper according to one embodiment of the present invention, the number of stains, and particularly, the number of large stains, was reduced compared to Comparative Examples 1 to 5 without using the wrapping paper according to one embodiment of the present invention. More specifically, comparing Examples 1 and 2 and Comparative Examples 1 to 4, the influences of the basis weight, pulp freeness and air permeability on stains were determined, and comparing Examples 1 and 2 and Comparative Example 5, the influence of the opacity on stains was determined.

REFERENCE SIGNS LIST

10 Non-combustible heated type smoking article
11 Filler
12 First wrapping paper
13 Second wrapping paper (tipping paper)
14 Paper tube part
15 Filter part
16 Mouthpiece part
20 Electric heating device
21 Battery unit
22 Control unit
23 Body
24 Heater
25 Heat transfer member
30 Electrically-heated smoking system

What is claimed is:

1. A wrapping paper for a non-combustible heated type smoking article, having a basis weight of 35 g/m$^2$ or more and 65 g/m$^2$ or less, a pulp freeness of 69° Schopper-Riegler (SR) or more, an air permeability of 20 Coresta Units (CU) or less, and an opacity of 85% or less.

2. The wrapping paper for a non-combustible heated type smoking article according to claim 1, wherein a water contact angle is less than 90°.

3. The wrapping paper for a non-combustible heated type smoking article according to claim 1, having 35 weight % or more of a filler.

4. A non-combustible heated type smoking article comprising a filler containing shredded tobacco and an aerosol generating base material, a tobacco rod part wrapped with a first wrapping paper that wraps the filler, and a mouthpiece part constituting an end on an opposite side to the tobacco rod part, the tobacco rod part and the mouthpiece part being connected using a second wrapping paper, which is the same as or different from the wrapping paper that wraps the filler,

TABLE 1

| | Paper physical properties | | | | | Evaluation of stains (being left for 4 weeks) | | | | |
|---|---|---|---|---|---|---|---|---|---|---|
| | Basis weight [g/m$^2$] | Pulp freeness [° SR] | Air permeability [CU] | Carbonic acid Ca [d %] | Opacity [%] | Number of (small) stains 0.9 ≤ L ≤ 2.7 | Number of (large) stains 2.7 ≤ L | (Small stain) % 0.9 ≤ L ≤ 2.7 | (large stain) % 2.7 ≤ L | (None) % — |
| Example 1 | 35 | 69 | 20 | 35 | 83 | 100 | 10 | 50 | 5 | 45 |
| Example 2 | 35 | 69 | 6 | 35 | 80 | 130 | 14 | 65 | 7 | 28 |
| Comparative Example 1 | 26 | 50 | 60 | 30 | 70 | 140 | 60 | 70 | 30 | 0 |
| Comparative Example 2 | 35 | 50 | 15 | 35 | 81 | 130 | 36 | 65 | 18 | 17 |
| Comparative Example 3 | 26 | 69 | 20 | 30 | 75 | 118 | 23 | 59 | 12 | 29 |
| Comparative Example 4 | 23 | 73 | 10 | 23 | 70 | 134 | 46 | 67 | 23 | 10 |
| Comparative Example 5 | 45 | 81 | 10 | 50 | 88 | 140 | 26 | 70 | 13 | 17 |

wherein at least one of the first wrapping paper and the second wrapping paper is the wrapping paper according to claim 1.

5. The non-combustible heated type smoking article according to claim 4, wherein the tobacco rod part includes a filler containing shredded tobacco and an aerosol generating base material, and a density of the filler is 250 $mg/cm^3$ or more, and a content of the aerosol generating base material in the filler is 5 weight % or more.

6. The non-combustible heated type smoking article according to claim 4, wherein the tobacco rod part includes a filler containing a fragrance material and a content of the fragrance material is 10,000 ppm or more.

7. An electrically-heated smoking system, comprising:

an electric heating device including a heater member, a heat transfer member that transfers heat from the heater member, a battery unit serving as a power source of the heater member, and a control unit for controlling the heater member; and the non-combustible heated type smoking article according to claim 4, which is fitted so as to come in contact with the heat transfer member.

8. A wrapping paper for a non-combustible heated type smoking article, having a basis weight of 35 $g/m^2$ or more, a pulp freeness of 69° Schopper-Riegler (SR) or more, an air permeability of 20 Coresta Units (CU) or less, and an opacity of 85% or less, wherein a base paper which is a base material used for the wrapping paper consists of a plant-derived fiber.

* * * * *